US007040869B2

(12) United States Patent
Beenker

(10) Patent No.: US 7,040,869 B2
(45) Date of Patent: May 9, 2006

(54) METHOD AND DEVICE FOR CONVEYING MEDIA

(75) Inventor: Jan W. Beenker, Wernhaldenstrasse 30, D-70184, Stuttgart (DE)

(73) Assignee: Jan W. Beenker, Stuttgart (DE)

( * ) Notice: Subject to any disclaimer, the term of this patent is extended or adjusted under 35 U.S.C. 154(b) by 278 days.

(21) Appl. No.: 10/380,369

(22) PCT Filed: Sep. 14, 2001

(86) PCT No.: PCT/DE01/03527

§ 371 (c)(1),
(2), (4) Date: Mar. 12, 2003

(87) PCT Pub. No.: WO02/23043

PCT Pub. Date: Mar. 21, 2002

(65) Prior Publication Data

US 2003/0175138 A1 Sep. 18, 2003

(30) Foreign Application Priority Data

Sep. 14, 2001 (DE) ..... 100 45 866

(51) Int. Cl.
*F04B 17/00* (2006.01)

(52) U.S. Cl. ..... 417/53; 417/413.2

(58) Field of Classification Search ..... 417/413.1, 417/53, 413.2, 415, 478
See application file for complete search history.

(56) References Cited

U.S. PATENT DOCUMENTS

| | | | | |
|---|---|---|---|---|
| 3,229,643 | A * | 1/1966 | Roudaut | 417/475 |
| 3,947,156 | A * | 3/1976 | Becker | 417/437 |
| 4,498,850 | A * | 2/1985 | Perlov et al. | 417/322 |
| 5,096,388 | A * | 3/1992 | Weinberg | 417/413.3 |
| 5,431,634 | A * | 7/1995 | Brown | 604/153 |
| 6,050,787 | A * | 4/2000 | Hesketh | 417/412 |
| 6,074,179 | A * | 6/2000 | Jokela et al. | 417/322 |

FOREIGN PATENT DOCUMENTS

| | | | |
|---|---|---|---|
| DE | 637 586 | * | 6/1939 |
| DE | 2 212 322 | | 3/1972 |
| DE | 22 11 096 | A | 9/1973 |
| DE | 77 12 359 | U | 9/1977 |
| DE | GM 7712359 | * | 9/1977 |
| DE | 42 44 619 | A1 | 12/1992 |
| DE | 199 19 908 | A1 | 4/1999 |
| EP | 0 015 180 | A | 9/1980 |
| JP | 06 200901 | A | 10/1994 |

OTHER PUBLICATIONS

International Search Report, WO 02/23043, dated Mar. 7, 2002.

* cited by examiner

*Primary Examiner*—Charles G. Freay
(74) *Attorney, Agent, or Firm*—Beyer Weaver & Thomas, LLP

(57) ABSTRACT

Disclosed is a method and a machine (displacement machine or similar) used to convey transportable media (gaseous, liquid, pasty or trickling). The drive produces a migrating wave.

25 Claims, 7 Drawing Sheets

METHOD AND DEVICE FOR CONVEYING MEDIA

STATE OF THE ART

The invention relates to a process and machine (displacement power engine etc.) for the feeding of transportable materials (gaseous, fluid, pasty, granular) as defined in introductory part of claim 1 or claim 2. Feeding devices comprising an elastically deformable wall element of a working chamber are mostly known as membrane pumps such as crank shaft devices (DE-OS 2212322 or DE-OS 19919908 and DE-PS 2211096) or wobble-plate engines (DE-OS 4244619 etc.) or hose pumps, where the drive for the elastically deformable element defining the working chamber (membrane, hose-wall etc.) acts on the wall element in a direction transverse to the feeding direction of the material fed. According to the function of an engine of this kind energy is transmitted to the material fed. This always is an intermittend and not a linear feeding action. According to the working way of these known displacement engines a standing wave is generated, i.e. in a pendulum pump, with a fixed intersection points on the imaginary axis, thus allowing an almost full compensation of the wave maximum and the wave minimum. Also with membrane pumps comprising slide bars (see U.S. Pat. No. 4,854,836), where several slide bars are placed one behind the other, a standing wave is pconnecting roduced in the material fed (hose pumps). Thus, in hose or similar pumps, the hose is squeezed similar to the rolling motion of a tire to expand afterwards and create a suction effect. In any case we have to do either with a reciprocating drive or with a continuous wave like motion.

The disadvantage of these known driving methods is, before all, a relatively high wear as the lateral areas of the wave always remains in the same place. This means that the maximal stress always happens in the same place. Independently of this phenomenon dead centres are created, here, requiring driving forces according to the changing driving frequency, i.e. in slowly running engines for pasty goods. If necessary, additional devices must be provided for overcoming these dead centres.

In another process known for feeding pasty or granular materials the material is fed upwards i.e. by a worm into an open chamber such as a groove with the disadvantage of considerable losses due to friction between material and feeding worm or groove.

There are also known membrane pumps where the drive is realised by piezoelectric elements (DE-OS 198934536 and DE-OS 3618106) presenting essentially the same disadvantages, especially for small feeding quantities.

Finally, drive engines for vessels are well known (DE-GM 7712359) where the material to be fed, water in this case, is driven through a chamber defined between an entry an exit opening. Due to the thrust effect of the material fed and the corresponding arrangement of the entry and exit aperture, situated essentially under the water level, the vessel is pushed forward. In this case also driving losses are considerable.

THE INVENTION AND ITS ADVANTAGES

The process according to the invention, comprising the features of the characterising part of claim 1 as well as the device according to the invention comprising the characterizing elements in claim 2, present the advantage that the points of intersection of the waves generated by the drive for feeding the material migrate in the feeding direction of the material. This means that they do not stand still in one place and that the points of intersection migrate along a fictive feeding axis with the material fed. Such migrating waves are known in nature in the propulsion of snakes, eels etc.. Accordingly, the wear in such engines is essentially better equilibrated between the driving and driven elements and the feeding of such material is essentially smoother. In this driving device an additional movement, overlaying the basic motion in another direction, produces a pulsating movement, which, according to the invention, generates the wave movement of the material. This allows avoiding friction and abrasion between the flexing wall elements and the fixed wall. This consequently means less wear of the device according to the invention as well as a lower noise level. It is also possible to use materials resisting to bending for the flexible wall element. As the material and especially the flexible wall are less exposed to stress, as compared to known devices, this material can be realized differently and with thinner dimensions. Equally, also novel materials can be used which wouldn't comply with current devices. Such materials susceptible to be used according to the invention comprise especially fibre reinforced plastic materials. These can be made impermeable to gas by the inclusion of thin metallic layers. Thus the device according to the invention can be used in new application fields such as in refrigerating and air conditioning applications. According to the invention and as opposed to state of the art devices, the resetting of the elastically deformable wall elements can be equally performed automatically in the pressure and/or suction direction.

According to an advantageous embodiment of the device according to the invention the elastically deformable wall elements in combination with the opposite fixed wall element, which are mostly rigid, both defining the working chamber, are able to build a sealing line perpendicular to the feeding direction, similar to a single wall hose pump where the two opposed walls are pressed together along a mostly perpendicular line. Such a cooperation of fixed and flexible wall elements allows the feeding quantity be controlled up to a full sealing in order to obtain higher pressures, depending on the distance remaining between the opposite wall elements.

According to a preferred embodiment of the invention the cooperation between the elastic wall elements and the inlet and outlet apertures of the working chamber enables performing a valve action. As soon as the elastic wall element closes the inlet aperture the material is fed forward also under higher pressure in direction of the outlet aperture. Equally well the closing of the outlet aperture and enlargening of the working chamber with the opening of the inlet aperture generates a suction effect on the material to be fed.

According to the invention, the sealing line respectively the distance between the elastic and the fixed wall element perpendicular to the feeding direction does migrate. Thus it is possible to control the migrating wave movement of the material fed.

The corresponding embodiment of the invention makes it possible that the sealing line perpendicular to the feeding direction or the approaching of the elastic and fixed wall element can migrate in the direction of feeding thus having the possibility to act on the the migrating wave within the material.

According to a basic embodiment of the invention the elastic wall element of the working chamber comprises a membrane susceptible to be activated for the desired drive in a direction perpendicular to the feeding direction. Preferably, such a membrane has a lengthy extension, i.e. an oval extension, where the inlet aperture is situated at one end and the outlet aperture at the other end. According to the invention an advantageous clamping and sealing of the membrane can be achieved for slow running as well as for fast running machines. Depending on the way the membrane is clamped, a natural resetting of the membrane can be achieved, depending on the particular design of a particular application.

According to a special embodiment of the invention the drive comprises a crank gear as well as a crank element transmitting the stroke to the elastic wall element. In order to generate the migrating wave the crank element is guided, during its stroke movements, along a predetermined channel so that the crank element performs, additionally to the movement generated by the stroke movement, a tilting movement in the feeding direction. This tilting movement resulting from the stroke of the crank gear and a cam-controlled crank element can be realised by a cam guide located between the crank gear and the elastic wall element. The cam guide, however, can also be located on the opposite side of the elastic wall elemen. It is important only that a disturbing movement overlays the stroke movement of the crank gear, thus transforming the fixed wave generated by the stroke movement into a migrating wave.

According to a preferred embodiment of the invention a laterally flexible form-locking support element is used for the transmission of the tilting crank movement generating the migrating wave onto the elastic wall element. This allows obtaining a corresponding degree of freedom between the driving end of the crankshaft and the contact point of the elastic element in a perpendicular direction.

According to a corresponding embodiment of the invention the form-locking support comprises a slide element located between the crank element and the elastically deformable wall element.

According to a corresponding advantageous embodiment of the invention the form-locking support presents the shape of a rectangular beam element directly transmitting the tilting movement of the form-locking support to the flexible wall element. This way the cranking/tilting movement is directly transmitted the to material to be fed thus generating a pulsating as well as a migrating wave.

Additionally and according to an advantageous embodiment of the invention a plate resistant to bending is located between the crank element and the elastic wall element transmitting the stroke and tilting movement to the elastic element over a large surface. This plate can act on the wall element in a floating way. In some cases it is fixeded to it and the plate floats relatively to the end of crank element. It is important that this plate has a supporting action for the elastic wall element so that, for other practical reasons, this wall element can be realised as a soft membrane.

According to a corresponding advantageous embodiment of the invention this plate preferably comprises a resilient material such as steel or hard plastic material.

According to a corresponding advantageous embodiment of the invention the features captured in claims 9 to 12 may also be applied to other driving means, in particular when the drive acts perpendicularly to the elastic wall element or membrane and when similar problems do exist.

According to a corresponding additional advantageous embodiment the invention the pulsating action is generated by several driving element acting perpendicularly to the feeding direction and located one after the other and acting on the deformable wall element (see U.S. Pat. No. 4,854,836 and also U.S. Pat. No. 5,961,298.

According to an advantageous embodiment of the invention and as in the other above-mentioned embodiments the elastically deformable wall elements are realised as a membrane having a length extension according to the driving device comprising several elements. This membrane can present an oval or almost rectangular shape. This essentially depends on additional functions, such as a valve function, the membrane has to fulfil or on how many driving elements are provided one after the other etc.

According to a further advantageous embodiment of the invention the driving device comprises a camshaft working together with sliding blocks at least directly contacting the membrane (see claim 9 to 12) to generate its movements. It is also possible, however, to use camshaft driven connecting rods or transverse shafts or swinging levers etc. So it is also possible to use a kind of worm device parallel to the feeding direction and which is in spiraling driving contact with the membrane through its peripheral edges. Depending on the radius of the worm device the fixed wall opposite the membrane and defining the working chamber has a concave shape comprising inlet and outlet apertures at the beginning and the end of this tunnel shaped working chamber.

According to an additional and advantageous embodiment of the invention the housing of the machine has a shape similar to a tube where the wall of the tube serves as fixed wall element.

According to an advantageous special embodiment of the invention the machine housing comprises two membranes parallel to each other and accommodates a double action driving device located between them. This allows realising a driving action, such as in an opposite cylinder type engine. The particular advantage of this embodiment is that the feeding generated by one driving element is offset as compared to the other thus producing smoother feeding and higher feeding capacity.

According to another general and particular embodiment of the invention the tubular housing has a circular cross section of the working chamber. As compared to an equally possible flatter shape of the working chamber where the membrane may make contact with the fixed wall element producing a kind of valve action, a machine comprising a working chamber with a circular cross section can be optimised so that no contact occurs between membrane and opposite fixed wall element.

According to another advantageous embodiment of the invention the drive device comprises at least indirectly transmitted magnetic forces. Especially with smaller pumps in medical or micro pump applications this driving device may present particular advantages.

According to a corresponding advantageous embodiment of the invention the magnetic or piezoelectric forces are generated and controlled electrically. This way it is possible to produce migrating electromagnetic fields, such as in a linear synchronous motor, activating the membrane. Especially in micro pumps at low pressure or in small compressors up to about 5 bar this may be realised by linear or electromagnetic fields migrating in curves. It may also be closed in a migraton wave mode by its own spring force. In analogy to chips the overall system may be realised in layers up to reaching hygroscopic critical values. The driving action can also be realised by magnetic coils like in loudspeakers or by swinging elements with a adequate transmission of movement.

A feeding machine according to the invention, where the driving acts on the material in a pulsating mode so as to generate a migrating wave in the material fed, can be realized in various ways mechanically and the applications of the invention are multiple. The invention can be applied not only for heavy duty and mean performance pumps but also for micro size applications where wavelike pumping foils can be used as elastic wall elements. The invention can specifically be applied in the medical field of micro techniques where a driving device comprising an axle cannot be accommodated. Another field of application is in compressors from high performance to micro embodiments.

According to another advantageous embodiment the invention it serves as a propelling device for vessels etc.. The "migrating wave" according to the invention generates propulsion movements similar to those of fish and snaks or the pumping action of jelly-fish. Basically the driving action is similar to boat propellers by soaking and repulsion. In this case the invention is used similar to a fluid flow engine. Similar to propulsion of sea elephants the invention can also be used as an amphibian vehicle in muddy environment and possibly on sand. A reverse application of the invention would be the bottom of a grove where the migrating wave action on the bottom would feed the material forward, similar to a vibrating conveyor belt. In an application according to the invention in boat drives an inlet opening is provided below water line at the bow as well as an outlet opening at the stem, a working chamber being provided between them. The driving device for the membrane located on the deck side of the boat can be realised in various ways. Equally well two such driving systems can be arranged parallel to each other in order to manoeuvre the boat according to their feeding capacity. It is also possible to provide a tube shaped device comprising a double action opposite crank drive and to use it as an outboard engine.

In a generally advantageous embodiment of the invention the elastically deformable wall element is a membrane clamped along its peripheral border. The cross section of the membrane always presents a wavy shape similar to the membrane of loudspeakers. This avoids buckling of material when the membrane transits its clamping plane as the extension in this clamping plane evidently is smaller than in the fully extended condition of the membrane. The membrane must, however, adapt itself to the condition in the clamping plane as well as to the extended condition where the membrane comes into contact with the fixed wall. The wavy contour of the membrane enables high frequencies, like in loudspeakers, without the disadvantage of buckling.

According to a further advantageous embodiment of the invention hydraulically or pneumatically controlled profiles are located within the membrane. Thus the membrane is able to continuously perform wavelike movements by itself. Additionally and according to the invention lengthy and flat or fibre piezo-elements are incorporated in the membrane in order to deform it for a driving action according to the invention. The deformation of surface elements by piezo-elements is well known in airplane wings and helicopter rotor blades.

Further advantages and preferred embodiments of the invention are disclosed in the subsequent description, drawings and claims of the invention.

DRAWINGS

Two embodiments of the invention are shown in the figures and described more precisely. In these figures.

Figure 1:
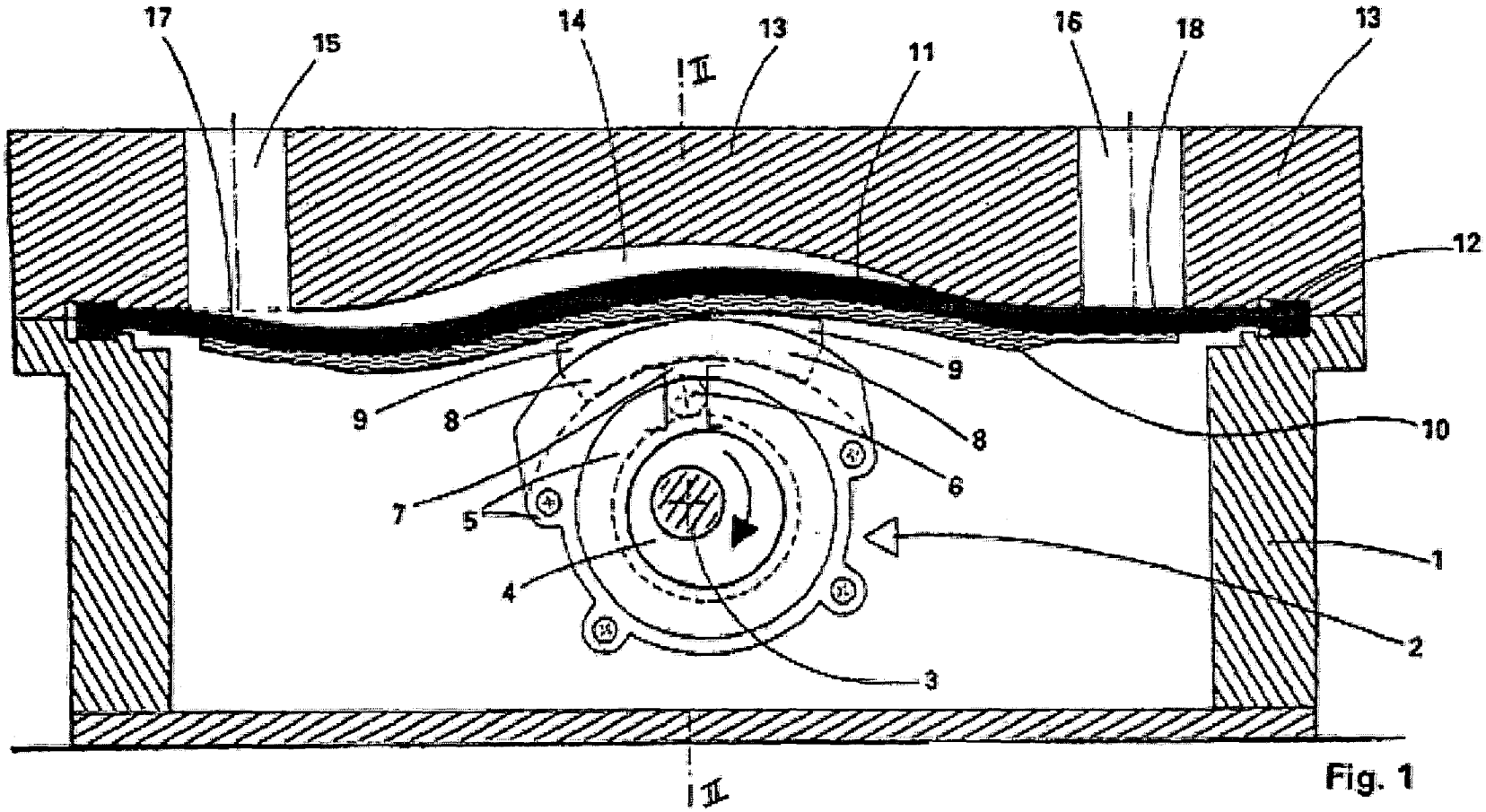
FIG. 1 is a cross section of a device according to the invention along line I—I in FIG. 2.
Figure 2:
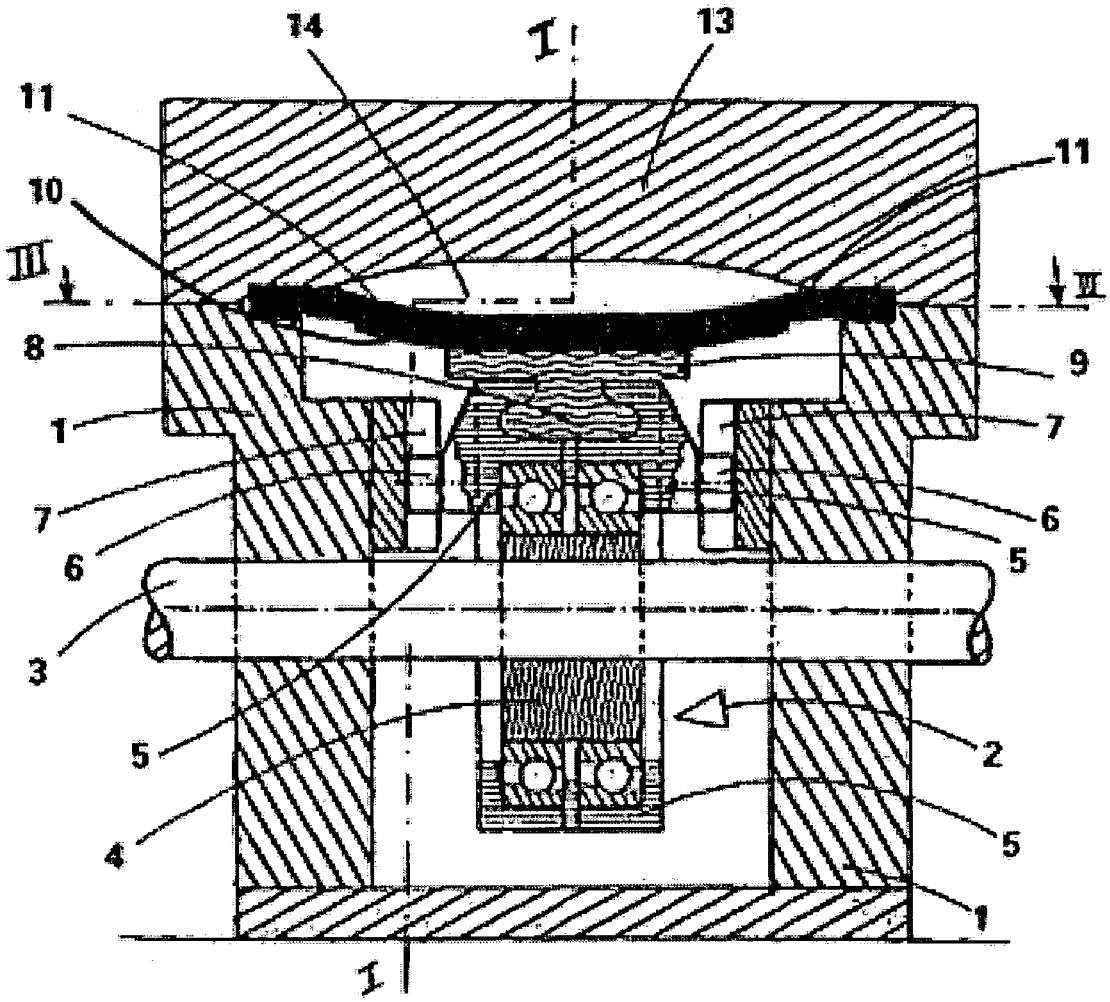
FIG. 2 is a cross section along line II—II in FIG. 1.
Figure 3:
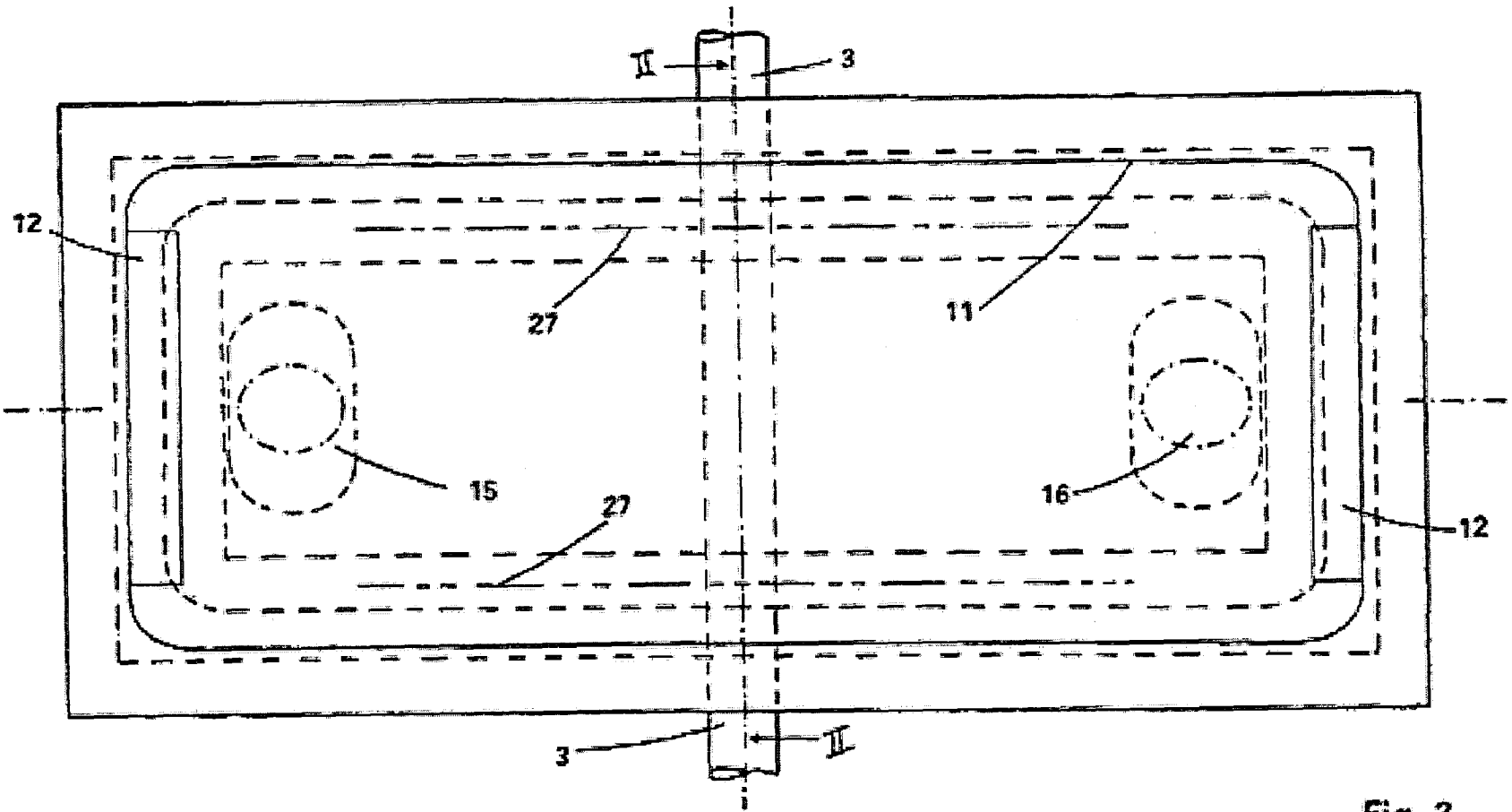
FIG. 3 is a partial section along line III—III in FIG. 2.
Figure 4:
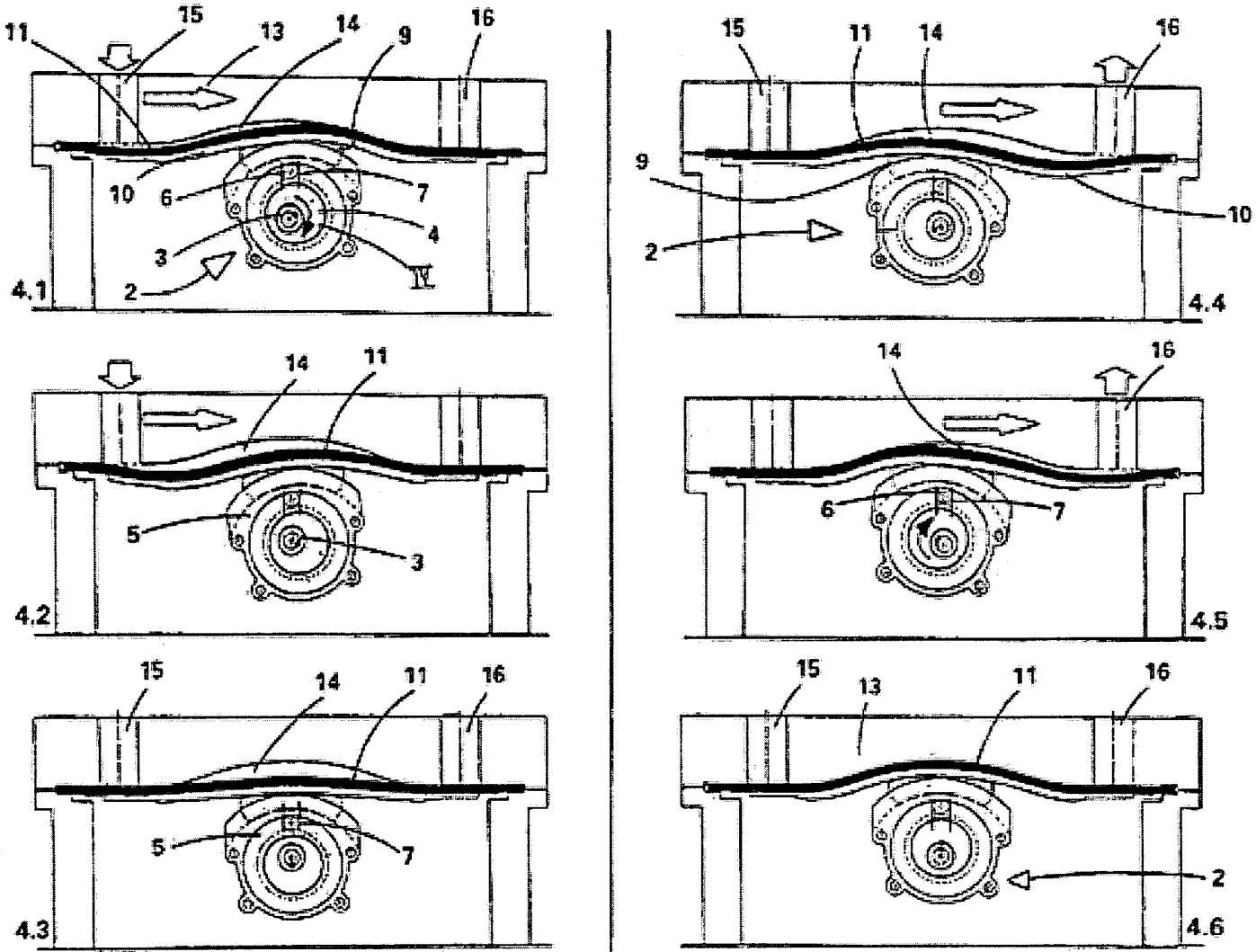
Figure 5:
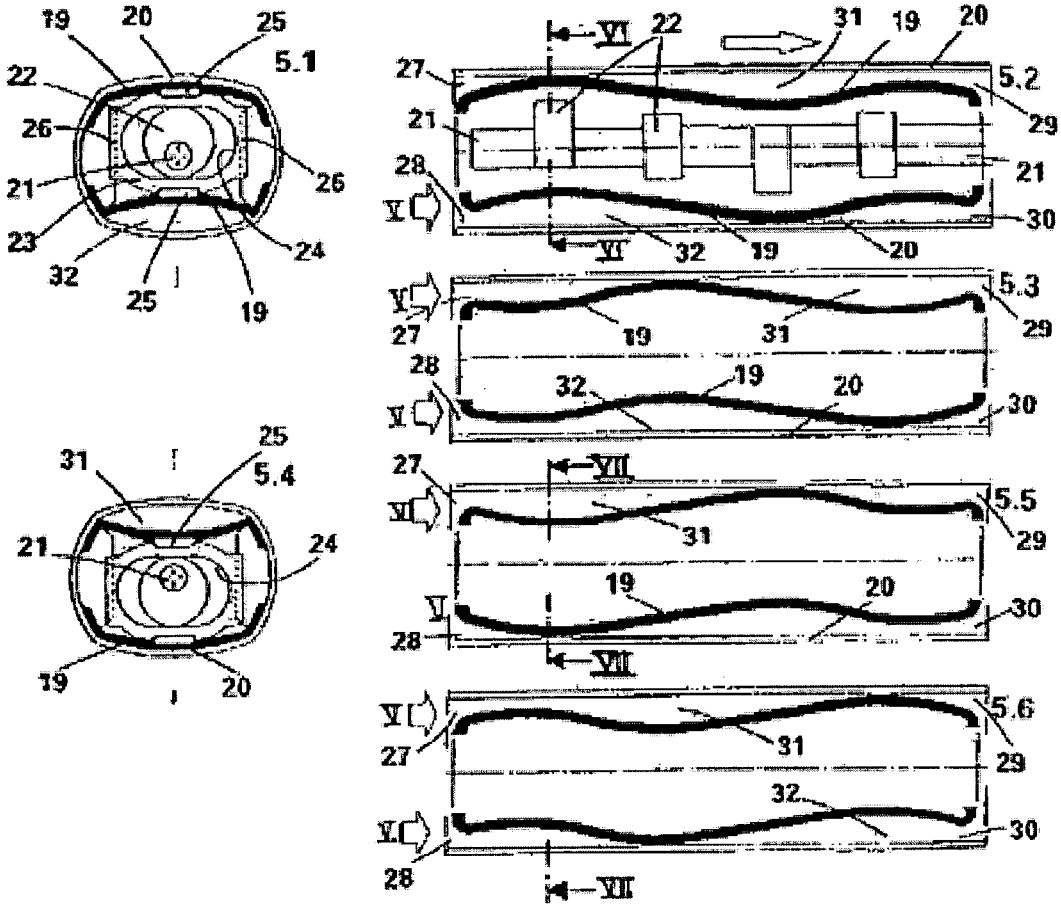
Figure 6:
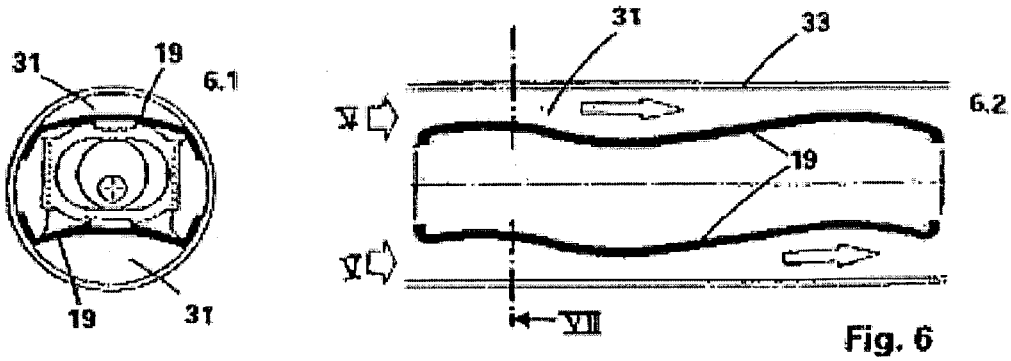
Figure 7:
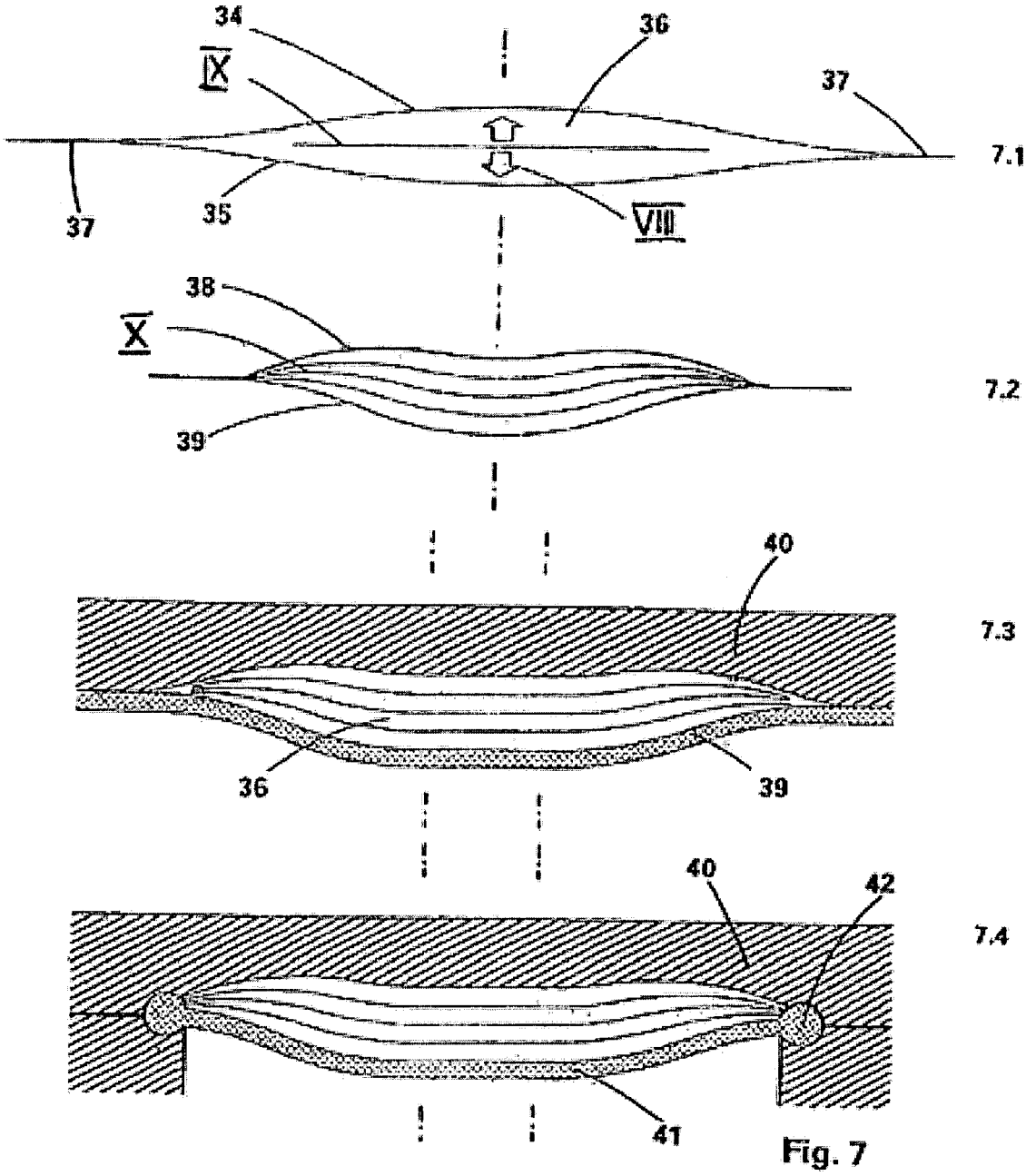

FIG. 4 schematically shows six different working positions in a smaller scale;

FIG. 5 is a schematic view of a second embodiment of the invention in a cross and length section and in different working positions;

FIG. 6 shows a variation of that second embodiment of the invention;

FIG. 7 shows an optimised membrane contour according to the invention and

Figure 8:
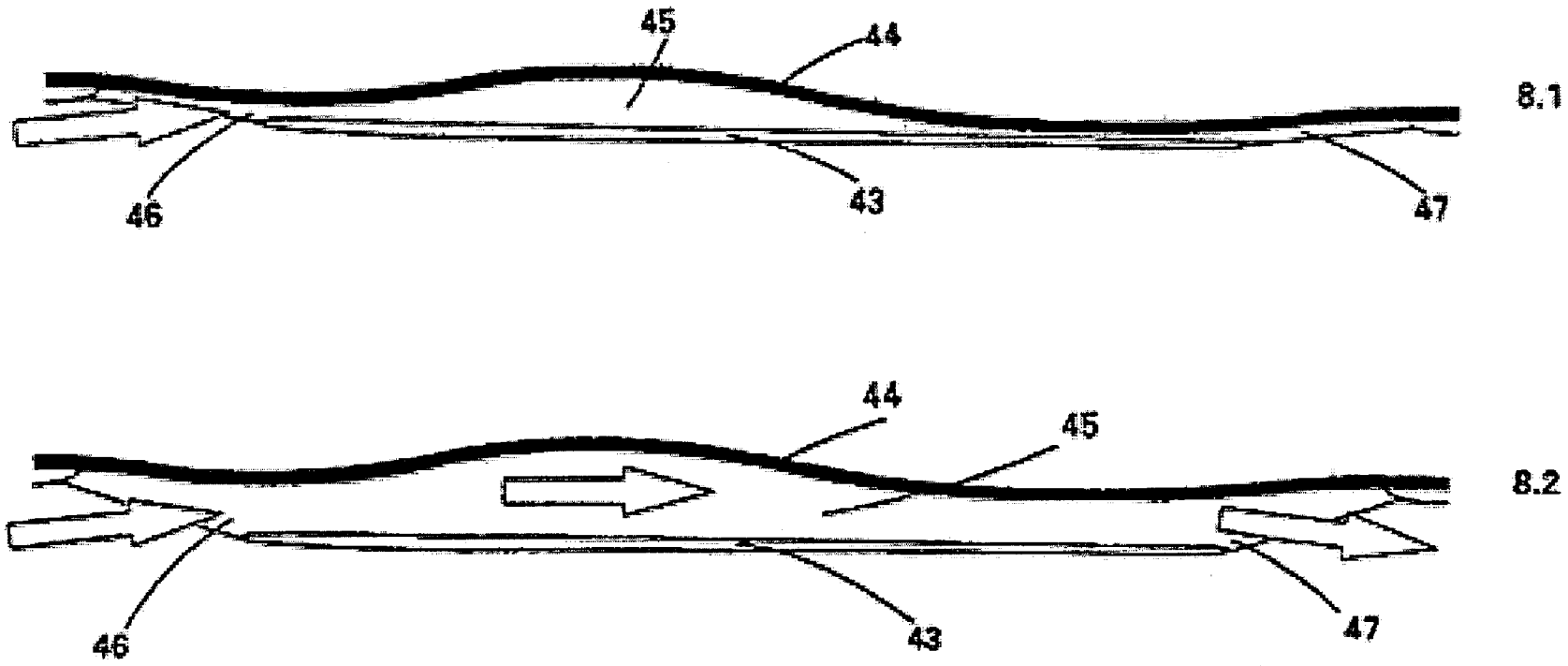

FIG. 8 shows an application as a boat drive.

DESCRIPTION OF THE EMBODIMENTS OF THE INVENTION

According to the embodiments of the invention shown in FIGS. 1 to 4, the invention is shown for a pump. In a pump housing 1 is located a crank device 2 comprising an eccentric disc 4 located on a driving axle 3 as well as a connecting rod 5 driven by it. At its far end this connecting rod comprises a pin 6 guided in a groove 7 of the pump housing 1. Thus the connecting rod 5, while going through its alternating stroke movements generated by the crank drive, generates a tilting movement as a consequence of the interaction between pin 6 and groove 7.

At its far end the connecting rod 5 acts on a sliding block 8 transmitting the pendulum stroke and tilting movement to a resilient plate 10 by means of a form-locking support 9. Thus and in the area of the form-locking support the resilient plate 10 does not only follow the stroke movements of the connecting rod 5 but also its tilting movements. These movements are transmitted through the resilient plate 10 to a membrane 11. Along its peripheral edge the membrane 11 is clamped between the housing 1 and a housing cover 13 by means of shoulders 12. The pump working chamber 14 is enclosed between membrane 11 and the housing cover 13 and comprises an inlet aperture 15 for aspiring material to be fed as well as an outlet aperture 16 for ejecting it. Sections 17 and 18 of the membrane 11 opposite the inlet 15 and outlet 16 aperture act on these apertures like valves. As soon as membrane 11 is lowered with these two sections 17 or 18 the valve is opened. Inversely, sections 17 and 18 close apertures 15 or 16 when reaching the position shown in FIG. 1.

FIG. 4 shows the working of the pump in six different working positions:

In working position 4.6 the crankshaft device 2 has pushed membrane 11 completely against the housing cover 13 thus closing inlet aperture 15 as well as outlet aperture 16.

In position 4.1 one can see that despite of a rotation of the driving shaft 3 to the right as indicated by arrow IV, form-locking plate 9 is tilted to the left thus opening the inlet aperture 15 of the working chamber 14 through elastic plate 10 and aspiring the material to be fed.

In position 4.2 driving shaft 3 is further rotating thus increasing the volume of working chamber 14.

In position 4.3 connecting rod 5 has reached its lowest point thus closing again the inlet aperture 15 of working chamber 14 through membrane 11 whereas the outlet aperture 16 is not yet open.

This happens in position 4.4 when the form-locking support 9 has tilted to the right thus opening outlet aperture 16 while inlet opening 15 stays closed. This way working chamber 14 is reduced and material is ejected by membrane 11.

Position 4.5 shows that working chamber 14 is further reduced through further rotation to finally reach the position shown in 4.6.

The cycle shown in FIG. 4 is repeated for each full rotation of driving shaft 3. Due to the pin 6, 7 guide of the connecting rod 5 its upper end not only performs stroke movements but also a pendulum tilting movement thus producing a pulsating action on the material to be fed on one hand and provoking a migrating wave in the material on the other hand.

In the second embodiment shown schematically in FIG. 5 two membranes 19 are mounted parallel and opposite to each other within a nearly tubular pump housing 20 and activated to generate a migrating wave by a camshaft 21 located between the feeding membranes 19. The feeding of material, as shown by arrows V, here occurs in length direction of the camshaft 21. The eccentric discs 22 of the camshaft 21 act on membranes 19 through a sliding block 23 accommodating the eccentric element 22 in the central opening 24 as well as through resilient plates 25. Sliding block 23 is guided along a guide channel 26 provided in the housing 20. In this case, the migrating wave is not generated by the guide channel but by the coordination of the four cams acting one after the other on the membranes. Consequently the function of the pump is not linear. In any case, the use of two membranes provides a double feeding action where the two working chambers function in a timely slightly offset mode due to the revolution of cams.

FIG. 5 shows various feeding phases 5.1 to 5.6 described in detail hereafter. In any case, inlet apertures are provided in 27 and 28 as well as and outlet apertures in 29 and 30. The working chambers of the pump are referenced as 31 and 32.

In phase 5.1 and 5.2 the inlet aperture 27 of working chamber 31 of the pump is closed whereas inlet aperture 28 of working chamber 32 is mostly open due to the corresponding angular position of camshaft 21. Outlet apertures 29 and 30 are open, however, so that the material to be conveyed can exit.

In phase 5.3 camshaft 21 has rotated for 90° so that membrane 19 is now pushing the material out of working chamber 31 through outlet aperture 29. In the same time material is sucked in through inlet aperture 27. In the working chamber 32 of the pump and due to its increase in volume, however, material is still sucked in through inlet aperture 28. Feeding process is stopped at outlet aperture 30 as membrane 19 touches pump housing 20 in this area.

In phase 5.4 and 5.5, where 5.4 is a cross section along line VII—VII, the lower membrane 19 touches pump housing 20 in this section with the consequence that inlet aperture 20 is now closed. In this phase camshaft 21 has rotated for further 90°. Upper working chamber 31 of the pump has correspondingly increased in volume on the left side while material is fed forward on the right side through outlet aperture 29.

In phase 5.6 camshaft 21 has rotated for another 90° again and outlet aperture 29 is closed now. Inlet aperture 27 is still open and sucks material to be fed into working chamber 31 as indicated by arrow V. In the working chamber 32, however, material is fed in direction of outlet aperture 30. In the same time material is filled in through inlet aperture 28.

Evidently, such feeding device can work with one membrane only with, consequently, less feeding capacity. According to the invention it is also possible to perform a cascade-like feeding where the camshaft is replaced by an electromagnetic drive system. In such case a cascade can be realised by a plurality of electro-magnetic transducers where the generator has as many outlet-points as there are transducers to be activated in the cascade. There are four exit-points on the frequency generator for a cascade with four steps and they are offset by 90° one to the other. The cascade is controlled in ascending sequence by equally ascending phases. According to the invention a migrating wave is generated by such a device and the cascade of stroke systems by means of a lengthy membrane connected to them. Feeding velocity, stroke-height and ascending time are controlled by the frequency of the generator.

FIG. 6 shows another variation of the second embodiment of the invention where the pump-housing 33 presents a circular cross section whereas the drive mechanism comprising camshaft 21 and membranes 19 is essentially the same as in the embodiment shown in FIG. 5. In this case membrane 19 does not touch the wall of pump housing 33 so that one has to do with a continuous feeding similar to that typical for fluid flow engines as opposed to an interrupted feeding mode while feeding.

FIG. 7 shows by means of functional lines, which design of the membrane and corresponding shape of the fixed wall will result in a minimum of buckling loss. By this means it is possible to clamp the peripheral bord of the membrane rigidly not allowing any shifting.

7.1 of FIG. 7 shows the classical example of a working chamber defined by a slightly concave upper wall 34 and a correspondingly undulated membrane 35, both defining working chamber 36 and meeting asymptotically along the periphery 37 where the membrane is clamped. During its working stroke in direction of arrow VIII towards fixed wall 34, membrane 35 suffers a certain buckling reaching its maximum when transiting line IX. This buckling results from the fact that the housing with the fixed wall 34 and clamping areas 37 are rigid whereas membrane 35 has an essentially larger extension in its extended position than in its position along line IX.

7.2 of FIG. 7 shows the design according to the invention where the fixed wall 38 presents a lip-like shape while membrane 39, in its extended lower position, is slightly curved. During its up-stroke membrane 39 transits central line X. It can be seen clearly that there is no buckling problem due to its undular shape.

7.3 of FIG. 7 shows a design feature comprising a pump-housing 40 and a membrane 39 both defining the working chamber 36.

7.4 simply shows that membrane 41 is clamped within the housing 40 by means of shoulder 42 without expecting any higher buckling or any particular stress in the clamping areas of membrane 41.

FIG. 8 shows an additional possibility to use the invention as driving engine for a vessel such as a boat. Here too the presentation is very schematical. The boat hull is referenced by 43 above which a working chamber 45 defined by a membrane 44. This working chamber comprises an inlet aperture 46 and an outlet aperture 47. By activating the membrane as described earlier, water is aspired through inlet aperture 46 and ejected through outlet aperture 47 alter having been fed through working chamber 45. Boat drives based on the displacement principle are well known. The advantage here is the crawling effect so that one can think of propulsion on mud or marshland and possibly on non-sticky granular sand. Such a vessel could be considered as an amphibious vehicle, which would be advantageous in muddy areas. Membrane 44 can be activated in various ways such as by a windmill device provided on the boat and transmitting its energy to the membrane.

In the same way the membrane can be used for driving a boat it also is possible, according to the invention, to reverse the function of the membrane in order to feed fluids as well as mud and granules such as sand etc. where the membrane is adequately driven and builds the bottom of an open grove All features and characteristics shown in the description, the following claims and the figures can be essential for the invention separately as well as in combination.

REFERENCE NUMBERS

1 pump housing
2 crankshaft device
3 driving shaft
4 eccentric disc
5 connecting rod
6 pin
7 guide channel
8 sliding block
9 form locking support
10 resilient plate
11 membrane resistant to bending
12 shoulder
13 housing lid
14 pump working chamber
15 inlet aperture
16 outlet aperture
17 part of 11
18 part of 11
19 feeding membrane
20 pump housing
21 cam shaft
22 eccentric disc
23 sliding block
24 central opening
25 resilient plate
26 guide
27 inlet aperture
28 inlet aperture
29 outlet aperture
30 outlet aperture
31 pump working chamber
32 pump working chamber
33 pump housing
34 fixeded wall
35 membrane
36 working cchamber
37 peripheral area
38 fixed wall
39 membrane resistant to bending
40 pump housing
41 membrane resistant to bending
42 hinge shoulder
43 keel bottom
44 membrane
45 driving chamber
46 in flow aperture
47 out flow aperture
I section
II section
III section
IV direction of rotation
V flow direction
VI section
VII section
VIII stroke direction
IX line
X central line

The invention claimed is:

1. A process for feeding feedable material within a working chamber comprising at least one inlet and one outlet aperture as well as at least one elastically yielding wall element resistant to bending, said process comprising:

activating the wall element is performed through discretely acting and jointed force transmission points in a pulsating wave mode;

generating a defined directional migrating wave within the material for its feeding in a feeding direction; and generating a tilting movement perpendicular to the feeding direction in addition to the defined directional migrating wave;

wherein, due to the resistance to bending the wall element, the wave motion generated by the deformations in the areas of the jointed force transmission points is continued beyond the various force transmission points.

2. A device for feeding feedable material, said device comprising:

a working chamber having a feeding direction for feeding a material between an inlet aperture and an outlet aperture and presenting at least one elastically yielding wall element resistant to bending;

at least one driving device acting on the wall element through at least one force transmission point to generate feeding, the force transmission between the driving device and the wall element comprising a joint located between the driving device and the at least one force transmission point, wherein the driving device generates a pulsating action on the wall element and thus on the material, causing a migrating wave to be generated within the material between the inlet aperture and the outlet aperture, the at least one driving device further comprising:

a shaft transmitting a stroke movement to the elastically yielding wall element;

guide means guiding the shaft during its stroke movement in a predetermined way for generating the migrating wave; and means on a far end of the shaft acting on the elastically yielding wall element for generating a tilting movement perpendicular to the feeding direction in addition to the stroke movement produced by the driving device;

wherein the wave motion generated by the deflections at the at least one force transmission point extends beyond the at least one force transmission point.

3. A device according to claim 2 wherein the elastically yielding wall element in combination with mostly fixed wall element located opposite the elastically yielding wall element and enclosing a working chamber builds up a migrating sealing line by approaching the wall element, the sealing line extending in a direction perpendicular to the feeding direction.

4. A device according to claim 3 wherein the elastically yielding wall element comprises sections acting as valves for the inlet aperture and outlet aperture.

5. A device as in claim 3 wherein the sealing line between the elastically yielding wall element and the fixed wall element built by the driving device migrates in the feeding direction (V) of the material.

6. A device according to claim 1 wherein at least pan of the elastically yielding wall element comprises a membrane activated by the driving device in a pulsating mode to generate a migrating wave within the material.

7. A device according to claim 1 wherein a form-locking block yielding in a direction perpendicular to the stroke movement is provided for transmitting the stroke/tilting movement generating the migrating wave to the elastically yielding wall element.

8. A device as in claim 7 wherein the form-locking block comprises a sliding piece located between the far end of the shaft and the elastically yielding wall element.

9. A device according to claim 2 wherein the form-locking block has a beam-like elongated rectangular shape extending in a direction perpendicular to the feeding direction.

10. A device according to claim 2 wherein a resilient plate generating the movements of the elastically yielding wall element is provided between the form-locking block and the elastically yielding wall element.

11. A device as in claim 10 wherein the resilient plate comprises elastic materials such as metal or reinforced plastic material.

12. A device according to claim 2 wherein the driving mechanism comprises a plurality of driving elements acting on the elastically yielding wall element in a direction perpendicular to the feeding direction (V) and disposed one behind the other for transmitting the pulsating driving forces to the elastically deformable wall element in a controlled mode.

13. A device as in claim 12 wherein the elastically yielding wall element comprises a membrane presenting an elongated shape according to the driving device having several driving elements.

14. A device as in claim 13 comprising a drive including a camshaft and several cams interacting with sliding blocks, which act on the membrane.

15. A device as in claim 13 comprising a tubular housing and where the tubular wall constitutes the fixed wall element.

16. A device according to claim 13 wherein two membranes are provided in the tubular housing parallel to each other and where a double acting driving device is located between these membranes.

17. A device according to claim 2 wherein the working chamber of the tubular housing has a circular cross section.

18. A device according to claim 2 wherein the driving device comprises magnetic or piezo elements.

19. A device according to claim 18 wherein the magnetic or piezo elements comprise at least one of: an electrical generating mechanism and a control mechanism.

20. A device according to claim 18 wherein the elastically yielding wall element comprises magnetizable material.

21. A device according to claim 2 comprising means for serving as a boat-driving engine.

22. A device according to claim 21 wherein the boat-driving engine is located in or outside a boat hull comprising an inlet aperture located below water level, a corresponding outlet aperture at the stern of the boat and a working chamber between them.

23. A device according to claim 2 wherein the elastically yielding wall element comprises a membrane which is clamped along its peripheral area and which independently of its working position presents a curved shape insuring a permanently neutral buckling or stretching behavior.

24. A device according to claim 23 wherein the membrane comprises hydraulic or pneumatic profile elements so that the membrane can perform continuous wave movements by itself.

25. A device according to claim 18 wherein the membrane comprises flexible elongated and flat or fibre-shaped piezo-elements incorporated in the membrane.

* * * * *